US007824238B1

(12) United States Patent
Winter

(10) Patent No.: US 7,824,238 B1
(45) Date of Patent: Nov. 2, 2010

(54) MARKER BUOY

(76) Inventor: Lynn A. Winter, 10419 Decatur Cir., Bloomington, MN (US) 55438

( * ) Notice: Subject to any disclaimer, the term of this patent is extended or adjusted under 35 U.S.C. 154(b) by 90 days.

(21) Appl. No.: 12/381,066

(22) Filed: Mar. 7, 2009

(51) Int. Cl.
*B63B 22/16* (2006.01)

(52) U.S. Cl. ..... 441/6; 441/126

(58) Field of Classification Search ..... 441/6, 441/123–126
See application file for complete search history.

(56) References Cited

U.S. PATENT DOCUMENTS

| | | | | | |
|---|---|---|---|---|---|
| 1,249,486 | A | * | 12/1917 | Polachek | 441/25 |
| 1,993,974 | A | | 3/1935 | McVicker | |
| 2,490,876 | A | | 12/1949 | Lewis et al. | |
| 3,005,215 | A | | 10/1961 | Colt et al. | |
| 3,089,156 | A | | 5/1963 | Hamm | |
| 3,653,085 | A | | 4/1972 | Rovner | |
| 3,942,203 | A | | 3/1976 | Perkins | |
| 4,074,380 | A | | 2/1978 | Parker | |
| 4,103,379 | A | | 8/1978 | Wolfe | |
| 4,405,303 | A | | 9/1983 | Smith | |
| 4,443,203 | A | | 4/1984 | Maertens | |
| 4,501,563 | A | | 2/1985 | Johnson et al. | |
| 4,501,564 | A | | 2/1985 | Cairone, Sr. | |
| 4,544,364 | A | | 10/1985 | Bankston | |
| 4,781,636 | A | | 11/1988 | Schurr | |
| 5,033,984 | A | | 7/1991 | Shroeder | |
| 5,188,551 | A | | 2/1993 | Keller | |
| 5,256,093 | A | | 10/1993 | Balstad | |
| 5,273,468 | A | * | 12/1993 | Nichols | 441/6 |
| 5,358,437 | A | | 10/1994 | Allen | |
| 5,376,035 | A | | 12/1994 | Forrest | |
| 5,613,888 | A | | 3/1997 | Lamphere | |
| 5,865,656 | A | * | 2/1999 | Sims | 441/6 |
| 5,947,780 | A | * | 9/1999 | Kellner et al. | 441/6 |
| 6,086,439 | A | * | 7/2000 | Vasile | 441/25 |
| 6,123,593 | A | * | 9/2000 | Mercer | 441/26 |
| 7,175,492 | B1 | | 2/2007 | Butler | |
| 7,311,575 | B1 | * | 12/2007 | Briles | 441/13 |
| 2004/0142613 | A1 | * | 7/2004 | Barden | 441/6 |
| 2004/0235371 | A1 | * | 11/2004 | Bosse et al. | 441/26 |

* cited by examiner

*Primary Examiner*—Stephen Avila

(57) ABSTRACT

A self-setting marker buoy comprising a floatation unit (20), including a hollow upper member (22), a separable end cap closure lower member (36) with a line storage spool (38) having a uniquely shaped line-trapping element (52) on its lower flange (50), anchor line (44), and anchor (68). The upper member (22) can be tapered inwardly toward the top to allow multiple upper members (22) to nest together for storage. Lower members (36) can also stack together. The line-trapping element (52) is in the shape of a disk having alternating slots (54) and spokes (56) at the perimeter thereof. When tossed onto the water, the weight of the anchor (68) causes the floatation unit (20) to tilt sufficiently to allow the release of anchor line (44) as the anchor (68) descends to the bottom of the water body. When the anchor (68) reaches the bottom, ballast (62) in the lower member (36) rights the floatation unit (20), and the line-trapping element (52) comes into effect to prevent any further release of anchor line (44).

20 Claims, 4 Drawing Sheets

MARKER BUOY

CROSS-REFERENCE TO RELATED APPLICATIONS

Not Applicable

FEDERALLY SPONSORED RESEARCH

Not Applicable

SEQUENCE LISTING OR PROGRAM

Not Applicable

FIELD OF THE INVENTION

This invention relates to floating markers that are anchored to the bottom of a water body to mark particular reference points, and they usually include a line-controlling feature that functions to prevent the release of excess anchor line after the anchor has descended to the bottom of the water body, thus preventing the marker from drifting from the selected location.

BACKGROUND OF THE INVENTION

Floating marker buoys are frequently used by fishermen, boaters, and others to mark specific locations on or below the water surface of a lake or river in order to remain at or near a particular location on the water body or to return to it. These locations include navigation routes, fishing areas, and submerged objects. The primary objective is to provide a highly visible, self-setting, floating marker that is anchored to the lake bottom and will not drift away from the designated location due to the action of wind, waves, or currents.

Presently available marker buoys usually provide a self-setting feature to limit the release of anchor line to only the length required to allow the anchor to reach the bottom of the water body. This eliminates slack in the line and the resulting drifting of the marker from its selected location. There are a number of marker types with different configurations, different means of releasing and retrieving line, and different means of preventing the release of excess anchor line. One commonly available marker type rotates about a horizontal longitudinal axis to release and rewind the anchor line. This marker type is often of a barbell or dumbbell configuration with the anchor line wound around a tubular rod integrally connected to a flotation sphere at each end thereof. Eccentric weights are provided inside of the flotation spheres to stop the rotation and the further release of line when the anchor reaches the bottom of the water body.

An example of this type is disclosed by Rovner in U.S. Pat. No. 3,653,085, issued on Apr. 4, 1972. These dumbbell shaped units don't provide much viewable surface area, especially when viewing the end of the unit. Because of their configuration and their use of eccentric weights, they float low in the water and are therefore not highly visible from significant distances. The user can easily loose sight of them in choppy water, dim light, or even during favorable viewing conditions. This frequently results in the user having to search in all directions to relocate the marker buoy. To counteract this problem, many fishermen assemble their own marker buoys using large plastic bottles tethered to anchors. These home-made markers are often cumbersome, but these larger units can be more easily located on the water surface.

The marker buoys that rotate about a horizontal axis are not well suited for use in combination with flags and aren't often used in combination with lights. When they are used with exterior mounted lights or flags, the lights or flags are exposed to the water during rotation. When used with interior mounted lights, they require access to the interior of the marker. The requisite small diameter of the line storage rod of a dumbbell shaped marker buoy results in a tedious and time consuming task to rewind the anchor line when retrieving the marker when the user decides to change locations or discontinue use. There are powered line winding devices available, but using them doesn't often make the process any simpler or easier.

The floating marker disclosed by Maertens in U.S. Pat. No. 4,443,203, issued on Apr. 17, 1984, rotates about a horizontal axis while unwinding anchor line, then by taking on water ballast, it tilts to an upright position to engage the line-stop to prevent the release of excess anchor line. Some limitations are inherent in the operation of this marker. This marker has vanes to stop the rotation of the unit when the anchor reaches the bottom of the water body. It would be necessary that the provided vanes be quite large to effectively stop the rotational momentum in order to prevent the release of excess line after the anchor reaches the bottom of the water body. Another possible limitation is, if there is slack line when the marker is tossed onto the water surface, this slack line may contact the line-stop flange and immediately be engaged by one of the slots in the line stop flange, thus preventing sufficient release of anchor line to enable the anchor to reach the bottom of the water body. If this should occur, the user would be required to retrieve the marker and re-deploy it. Another limitation of this marker is that it could drift some distance during the period when the water is filling the ballast chamber to right the marker and bring the line-stop into effect. This marker is also limited in that it can only function in a clockwise direction of rotation during deployment. Also, in retrieving this marker, the ballast water would drain out of the marker, which could be messy or uncomfortable for the user, especially during cold weather.

BRIEF SUMMARY OF THE INVENTION

The objects of the invention are:

(a) To provide a highly visible, reasonably simple, versatile, effective, reliable, and easily manufactured floating marker buoy having significant improvements over currently available models, especially those intended for use by fishermen and boaters.

(b) To provide a marker buoy having greatly improved visibility options such as a scalable size configuration, a removable flag, a removable lighting device, and the inclusion of light reflective material.

(c) To provide a marker buoy with an improved self-setting feature, one that does not depend upon rotation of the marker with the resultant rotational momentum that can cause the release of excess anchor line, allowing the marker buoy to drift away from its selected location.

(d) To provide a marker buoy that requires considerably less storage space and less display space than those currently in general use, a marker buoy of which multiple units can nest together to be compactly stored without cumbersome dangling parts.

(e) To provide a marker buoy with a line keeper clip for optional use during periods of extremely severe wind, waves, or currents, and a clip that can be used to secure the anchor line for storage.

This invention is a self-setting marker buoy comprising a hollow shell upper member, a lower end cap member, an anchor line, and a weighted anchor. The lower member includes a line storage spool having a lower flange with a line-trapping element. A removable lighting device and a removable flag are included for optional use. A fixedly attached line keeper clip is also included for optional use.

The upper and lower members can be securely connected together to provide a watertight marker body, or they can be separated for storage or to provide access to install the removable lighting device. The hollow shell upper member is composed substantially of transparent or translucent material to allow the passage of light. It has a boss with an axially centered bore positioned at the top of the marker unit to receive and secure the end of the staff of the removable flag. The upper member is of generally hemispherical, cylindrical, conical, cubic, bell, or other suitable shape but it can be tapered inwardly toward the top to allow multiple upper members to be nested together for convenient storage and reduced storage space.

The lower member forms the base of the marker body and serves as a closure cap for the hollow shell upper member. It includes the line storage spool with its lower flange having the line-trapping element. This line-trapping element includes alternating, particularly shaped slots and spokes radially disposed around the perimeter to partially impede and slow the release of the anchor line as the anchor descends, and then to trap the anchor line and prevent further line release after the anchor reaches the bottom of the water body. The line storage spool also serves to store the anchor over the wound anchor line when the marker buoy is not in use. The lower member has an attachment for the removable lighting device, and it has fixed ballast to right the marker body and maintain it in an upright attitude after the anchor reaches the bottom of the water body. The underside of the lower flange of the lower member has a concentric groove, shaped to receive the top rim or upper flange of another lower member to facilitate stacking multiple lower members for storage. The lower member also includes the line keeper clip, fixedly attached to the underside thereof as an option to be used at those times when wind, waves, or currents are too severe for normal operation of the line-trapping element. The line keeper clip can be used to provide a positively secured, fixed anchor line length from the marker buoy to the anchor. It also serves to secure the anchor line when it is completely wound onto the line storage spool during storage.

The anchor is U-shaped to fit snuggly over the wound anchor line on the line storage spool during storage.

The advantages of the invention are:

(a) The marker buoy presents an upright posture extending vertically from the water surface providing an elevated viewing surface, highly visible from any direction.

(b) The marker can be used with or without the removable flag. The flag can be installed and used to provide visibility at even greater distance when desired.

(c) The marker buoy includes the use of light reflective material to improve visibility.

(d) The marker buoy can be used with or without the removable lighting device. The lighting device can be installed and used for improved visibility in dim light or at night.

(e) The upper hollow shell member can be tapered inwardly toward the top allowing multiple upper members to nest together for convenient storage and reduced storage space while not in use. The lower flange of the lower member has a concentric groove on its bottom surface shaped to accept the upper flange of another lower member for stacking multiple lower members to provide convenient storage. The reduced storage space is an advantage, especially to those boaters who frequently carry and use multiple marker buoys.

(f) Rewinding the anchor line is easy due the relatively large diameter of the line storage spool.

(g) The marker buoy functions by tilting of the vertical axis, thus keeping the removable flag and removable lighting device out of the water.

(h) Most other marker buoys either rotate or have a reel that rotates to release anchor line, and are subject to overrun and the resulting release of excess anchor line after the anchor reaches the bottom of the water body. The present invention releases line by its unique tilting action and does not develop rotational momentum and the resultant release of additional slack line after the anchor reaches bottom.

(i) The marker buoy is designed to allow compact storage without any dangling parts to get tangled. During storage, the wound anchor line is secured by the line keeper clip.

(j) The floatation unit has fixed ballast and doesn't rely on water ballast that is of low specific gravity and can be messy when it drains from the marker after retrieval.

(k) When wind, waves, or currents are especially severe, the line keeper clip at the underside of the marker buoy can be manually set to provide a positively secured, fixed anchor line length to prevent the marker from drifting.

This invention provides a marker buoy with a large number of features and options that solve problems inherent with currently used units. The user can select those options that best meet the requirements for the conditions encountered at any given time. The particularly unique features and options include the stacking capability for storing multiple members of the unit, the removable flag, and the removable lighting device. A major distinction of the invention is the unique tilting action of the marker buoy to release anchor line as the line slides off of the edge of the lower spool flange during anchor descent, and then for the floatation unit to right itself and trap the line after the anchor reaches the bottom of the water body.

These and other objects, features, aspects, and advantages of the invention will become more clearly understood from the following detailed description, which read together with the appended drawings, disclose representative embodiments of the invention.

DRAWING REFERENCE NUMERALS OF THE COMPONENTS

| | Component |
|---|---|
| 20 | floatation unit |
| 22 | upper member |
| 24 | boss |
| 26 | bore |
| 28 | flagstaff attachment means |
| 30 | flagstaff |
| 32 | removable flag |
| 34 | connecting means |
| 36 | lower member |
| 38 | line storage spool |
| 40 | upper flange |
| 42 | spool body |
| 44 | anchor line |
| 46 | lighting device attachment means |
| 48 | removable lighting device |
| 50 | lower flange |
| 52 | line-trapping element |
| 54 | slot |
| 56 | spoke |
| 58 | bevel |
| 60 | groove |
| 62 | ballast |
| 64 | recess |
| 66 | line keeper clip |
| 68 | anchor |

DETAILED DESCRIPTION OF THE INVENTION

Figure 1:
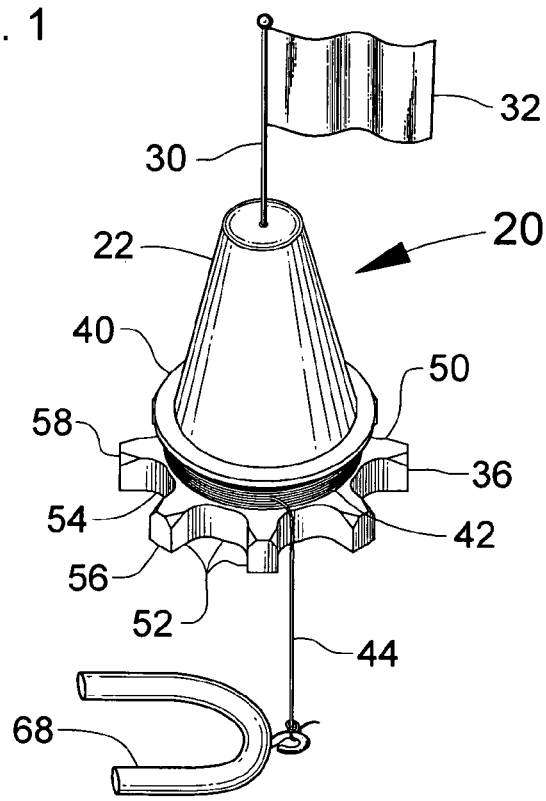
FIG. 1 is a perspective view of one embodiment of the invention in a configuration with six slots and six spokes. It is shown in the upright or in-use position with the removable flag attached.

With reference to the drawings, and wherein like numerals designate like parts, and with particular reference to FIG. 1, a self-setting marker buoy is disclosed having a floatation unit generally indicated by reference numeral 20, comprising an upper member 22, a lower member 36, an anchor line 44, and an anchor 68.

Figure 7:
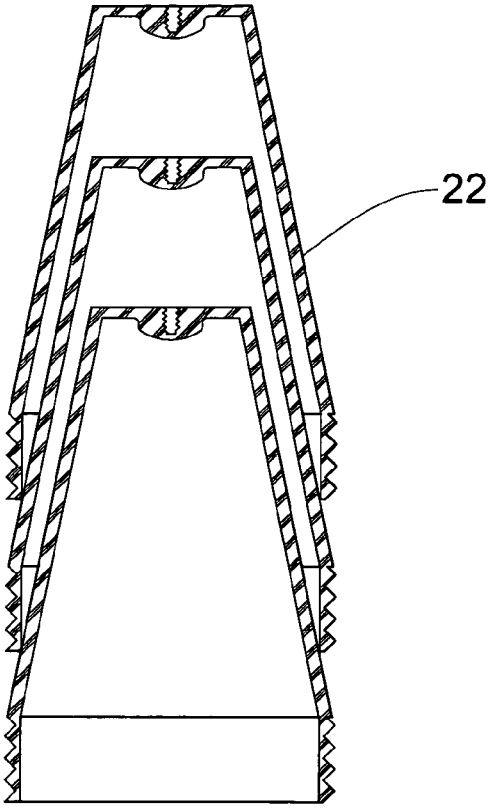
FIGS. 7 and 8 are vertical center sectional views showing how multiple upper members and multiple lower members, respectively, can be nested or stacked.

The outer shell of floatation unit 20 can be composed of a variety of materials including durable watertight plastics. The preferred manufacturing method is injection molding using a plastic material such as high-impact polystyrene or polyvinyl chloride. Fluorescent materials, colored pigments, and dyes can be incorporated into the material for enhanced visibility. Interior or exterior colored coatings or light-reflective materials of various types can also be used. Upper member 22 is of a transparent or translucent, hollow or of a foam-filled shell configuration and, if hollow, can be tapered inwardly toward the top to allow multiple upper members to be nested together for storage as depicted in FIG. 7. Upper member 22 can be of numerous shapes including bell, hemispherical, cylindrical, conical, cubic, and various others.

Figure 6:
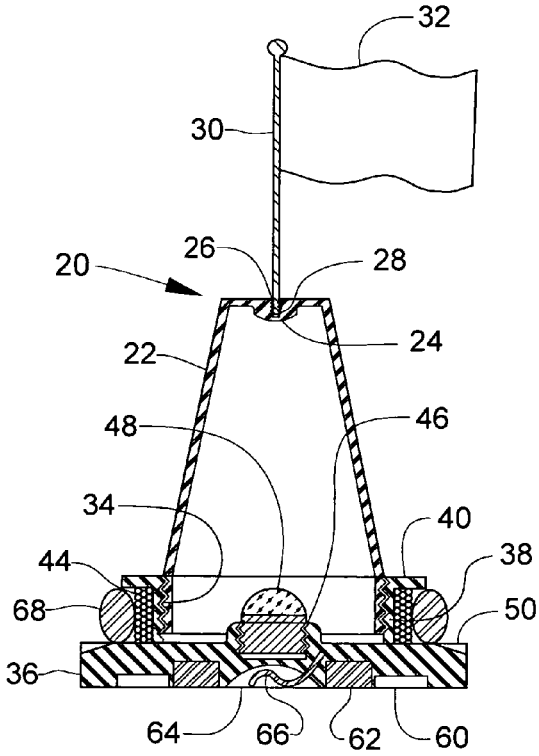
FIG. 6 is a vertical center sectional view of the marker buoy in the standby condition with the flag installed and the anchor mounted on the line storage spool, taken along Line 6-6 of FIG. 5.

Upper member 22 comprises a boss 24, either internally or externally disposed, and axially centered at the top of upper member 22. Upper member 22 also has a bore 26, axially centered and extending downwardly partially through the combined thickness of the shell of upper member 22 and boss 24, thus allowing bore 26 to receive and secure the lower end of a flagstaff 30 of a removable flag 32 as shown in. FIG. 6. A flagstaff attachment means 28 is provided to attach the lower end of flagstaff 30 within bore 26. Flagstaff attachment means 28 can be a threaded connection, friction connection, twist-lock connection, or other detachable connection capable of securing and supporting flagstaff 30. Flagstaff 30 is an axially centered slender, substantially rigid length of metal or plastic material. In order for floatation unit 20 to remain watertight when flagstaff 30 is removed, bore 26 does not penetrate entirely through the combined thickness of the shell of upper member 22 and boss 24.

Figure 4:
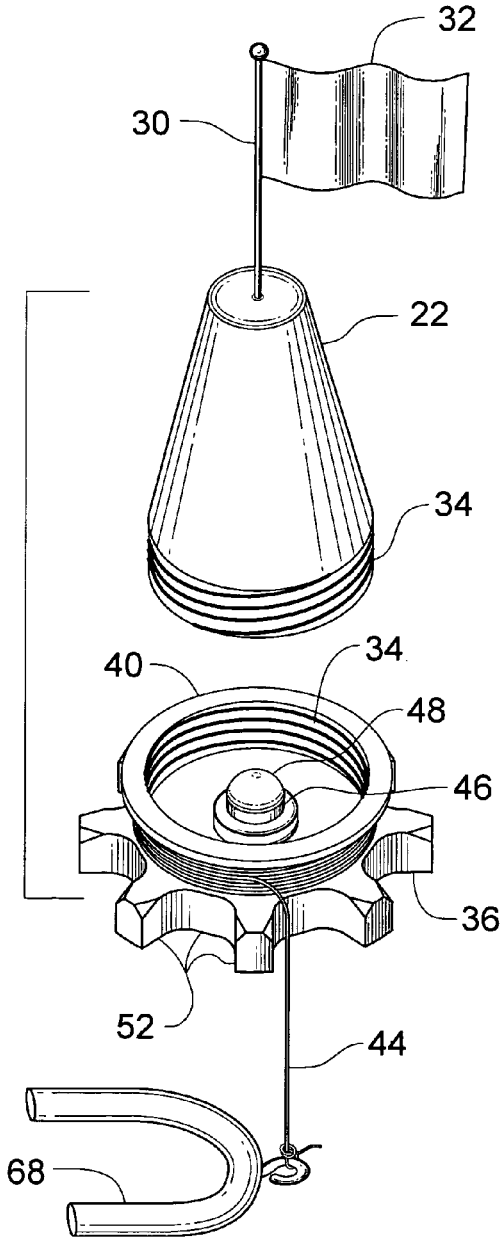
FIG. 4 is a perspective view showing the upper member and lower member separated.
Figure 5:
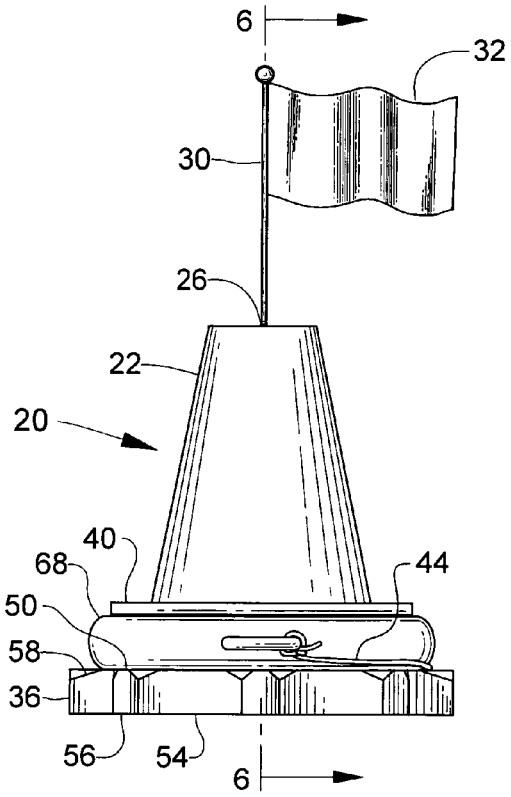
FIG. 5 is a vertical front view of the marker buoy with the anchor placed around the line storage spool.

Upper member 22 further comprises one of the mating parts of a connecting means 34 that allows upper member 22 to be securely fastened to lower member 36 to provide a watertight connection allowing floatation unit 20 to float on the water surface during use. Connecting means 34 can be a threaded connection, twist-lock connection, clamping connection, or other suitable means of providing a secure but separable connection as shown in FIG. 4.

Lower member 36 comprises the other mating part of connecting means 34 and serves as a watertight closure cap when connected to upper member 22. Lower member 36 further comprises a line storage spool 38, having a spool body 42 that is of cylindrical shape, an upper flange 40 that is of a disk shape, and a lower flange 50. Lower flange 50 is also of a disk shape and includes a line-trapping element 52 at the circumference thereof. Line-trapping element 52 can comprise one or more grooves or slots 54, one or more fingers, teeth, or spokes 56, or a combination of alternating slots 54 and spokes 56 disposed radially along the periphery of lower flange 50. Spokes 56 may be narrowed and have bevels 58 at the outer ends thereof. The particular shape of slots 54 and beveled spokes 56 provides the surface of line-trapping element 52 with reduced friction to minimize wear, and to control anchor line 44 while traveling through slots 54 and over spokes 56 during the descent of anchor 68.

Lower member 36 further comprises a lighting device attachment means 46 wherein a removable lighting device 48 can be attached within floatation unit 20 for use at night. Lighting device attachment means 46 and removable lighting device 48 can also be attached to boss 24 within upper member 22. Lighting device attachment means 46 is shown on the cross-sectional view of FIG. 6. It can be a threaded connection, friction connection, magnetic connection, twist-lock connection, clamp, clip, or other similar means of attachment. Removable lighting device 48 can be a small battery-powered light, a light emitting diode, luminescent light sticks, or similar device capable of producing constant or intermittent diffused illumination through the transparent or translucent material of upper member 22. An alternate location for the light (not shown on the drawings) would be to have it removably mounted on the exterior surface of upper member 22.

Figure 8:
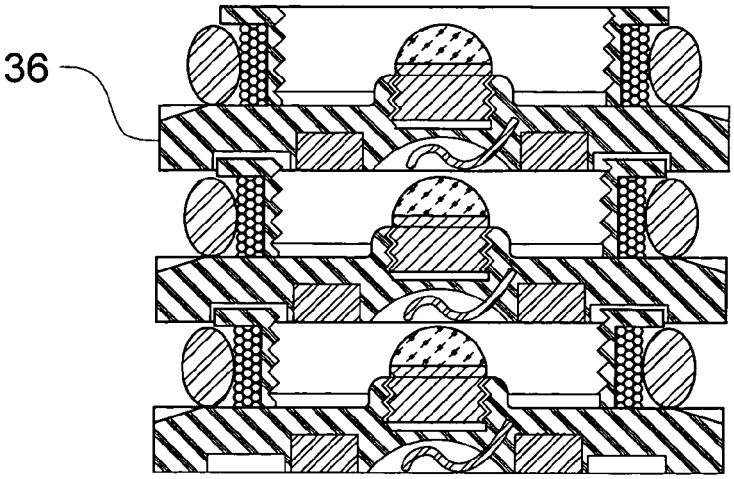

Lower member 36 further comprises a ballast 62 which is of high specific gravity material such as concrete or steel; a concentric groove 60, shaped and adapted to receive the upper flange 40 of another lower member 36 to facilitate storage of multiple lower members 36; and cavity, hollow, or recess 64 which is axially centered at the underside of lower member 36. Recess 64 is of an upwardly concave or dome shape and serves to contain retainer clip or line keeper clip 66 in a position above the bottom surface of lower member 36. This recessed positioning of line keeper clip 66 is for the purpose of allowing multiple lower member 36 units to be stacked on one another for storage, even without requiring the removal of removable lighting device 48. The stacked arrangement of multiple lower members is illustrated in FIG. 8.

The purpose of line keeper clip 66 is to provide a supplemental positively secured means of preventing the release of excess anchor line 44, and it is intended to be used during periods of extremely severe wind, waves, or currents. It also serves to secure anchor line 44 when anchor line 44 is completely wound onto line storage spool 38 during storage. It can be an elongated wire-like or bar-shaped element. Line keeper clip 66 is disposed somewhat transversely to the vertical axis of floatation unit 20 and runs generally along the surface of recess 64 as shown in FIG. 6. It is composed of flexibly resilient material such as steel, plastic, or any other suitable material. Line keeper clip 66 is fixedly attached at one end thereof to the surface of recess 64, and it provides a narrow gap at its other end between itself and the surface of recess 64, the gap being shaped to receive anchor line 44 which can then be further urged between line keeper clip 66 and the surface of recess 64, thus line keeper clip 66 will springably clamp and hold anchor line 44, and prevent line 44 from exiting through the gap at the free end of line keeper clip 66 during use. With this arrangement, line-trapping element 52, then acting in combination with line keeper clip 66, will positively prevent the further release of anchor line 44, thus providing a secured predetermined length of anchor line 44 extending from floatation unit 20 to anchor 68.

Anchor line 44 is connected at one end to line storage spool 38, then wound around spool body 42, and the other end thereof is securely connected to anchor 68. Anchor line 44 is of flexible, abrasion-resistant material such as nylon, Dacron, or high-strength fishing line. It can be slightly elastic or have an elastic segment at the anchor end thereof to counteract the abrupt variations in line tension forces from wind, waves, or currents. Anchor 68 is of high specific gravity material such as steel, and is of sufficient weight to cause floatation unit 20 to tilt substantially and overcome the effect of line-trapping element 52, allowing the release of anchor line 44 as anchor 68 descends downwardly when the marker buoy is tossed or placed onto the water surface.

Operation and Use of the Invention

The marker buoy can be used in various ways: (1) without removable flag 32 or removable lighting device 48, (2) with removable lighting device 48 detachably mounted to lighting device attachment means 46 within the hollow shell of floatation unit 20, (3) with removable flag 32 having the lower end of its flagstaff 30 detachably installed using flagstaff attachment means 28 located on top of floatation unit 20, or (4) with both removable flag 32 and removable lighting device 48 installed.

Figure 2:
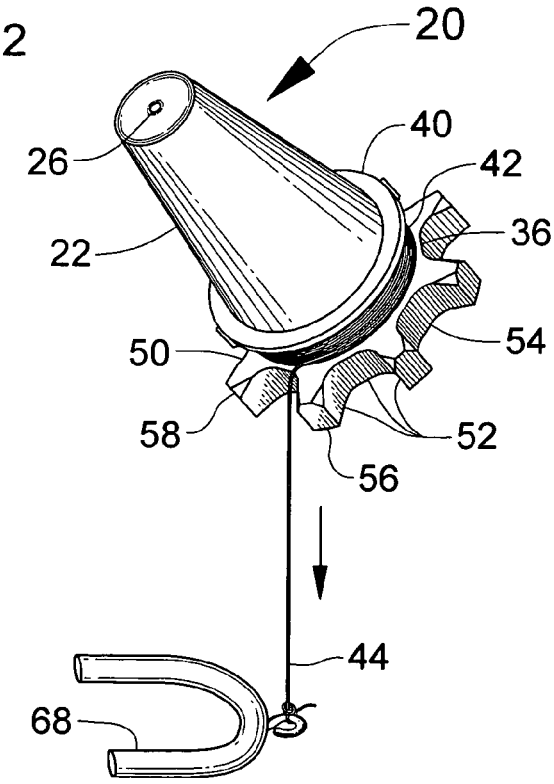
FIG. 2 is a perspective view of the marker buoy according to the invention in the tilted position that occurs during anchor descent
Figure 3:
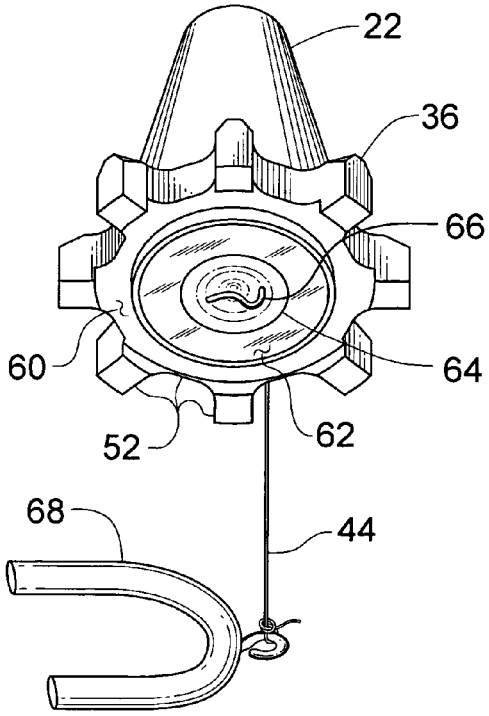
FIG. 3 is a perspective bottom view of the marker buoy.

When the user wants to mark a particular location on the surface of a water body, he or she removes the marker buoy from its storage location and ensures that upper member 22 and lower member 36 are securely connected together forming watertight floatation unit 20. Then he or she disengages anchor 68 from its storage position on line storage spool 38, and he disengages anchor line 44 from line keeper clip 66. After disengaging anchor 68 and anchor line 44, the user then tosses or places floatation unit 20 and its now disengaged anchor 68 onto the water surface at the selected location. Gravity will cause anchor 68 to begin to descend downwardly from the water surface with the tension in anchor line 44 substantially tilting floatation unit 20 and pulling anchor line 44 off of line storage spool 38 and over the edge of lower flange 50 as illustrated in FIG. 2.

The tendency of ballast 62 to right floatation unit 20, along with the tendency of line-trapping element 52 to trap anchor line 44, will be overcome by the tension in anchor line 44 causing floatation unit 20 to tilt substantially from an upright attitude. Slots 54 and spokes 56 of line-trapping element 52 will impede and slow, but not stop, the descent of anchor 68 as it continues to travel to the bottom of the water body. As anchor line 44 continues to slide off of the edge of lower flange 50, in and out of each slot 54, and over the end of each spoke 56, progressing in a circular path, the tilt angle of floatation unit 20 will also progress in a coincident circular path. When anchor 68 reaches bottom, tension in anchor line 44 is greatly reduced, and ballast 62 causes floatation unit 20 to right itself, causing line-trapping element 52 to come into effect to trap anchor line 44 as illustrated in FIG. 1. The line-trapping element 52 thus prevents the release of any further anchor line 44 and causes floatation unit 20 to remain in close proximity to a point directly above anchor 68.

If wind, waves, or current conditions are too severe for the normal self-setting operation of line-trapping element 52, the user may elect to secure anchor line 44 within line keeper clip 66 housed within recess 64, thus line keeper clip 66, acting in combination with line-trapping element 52, provides a positively secured, preselected, fixed length of anchor line 44 for use during extreme conditions.

When the user wants to discontinue use, he or she retrieves the marker buoy and rewinds anchor line 44 onto spool body 42 of line storage spool 38. The user then places anchor line 44 into line keeper clip 66, and he places anchor 68 onto spool body 42. If the user desires, he or she can then disconnect upper member 22 from lower member 36 by separating them at connecting means 34, and place multiple lower members 36 in a stacked arrangement by positioning the upper flange 40 of one lower member inside of the bottom groove 60 of another lower member. And the user can place multiple upper members 22 in a nested arrangement for convenient storage and reduced storage space. The stacked positioning of multiple upper members and multiple lower members is shown on FIGS. 7 and 8 respectively.

CONCLUSION

From the above description, a number of significant advantages of these embodiments of this invention become apparent. It should be evident that this invention provides a number of advantages worthy of patentable merit over the prior art.

While the above description contains many specifications, these should not be considered as limitations on the scope of the invention, but rather as an exemplification of the embodiments detailed hereof. Other variations are possible. For example, the floatation unit, especially the upper hollow shell member can have various shapes. The slots and/or spokes of the line-trapping element can be made in different shapes and sizes or provided in numbers different from those shown. The removable lighting device can be mounted at various locations. For example, it can be mounted on the boss inside of the upper member.

Workers skilled in the art will recognize additions, deletions, and other modifications that can be made in form and detail without departing from the spirit and scope of the invention. Thus the scope of the invention should be determined by the appended claims, and not by the specific examples given.

I claim:

1. A marker buoy of the self-setting type for marking selected locations on a body of water, said marker buoy comprising:

a floatation unit further comprising an upper member and a lower member, said floatation unit being substantially air-filled to cause it to float;

a line storage spool comprising an upper flange, a spool body, and a lower flange axially centered on and integral with said lower member;

a line-trapping element selected from the group consisting of at least one slot, at least one spoke, and a plurality of at least one slots and at least one spokes, said line-trapping element being integral with said lower flange and being radially disposed along the periphery of said lower flange, said slots and said spokes being uniquely shaped and adapted to allow an anchor line to deploy by slipping in and out of each said slot and over the end of each said spoke, progressing in a circular path around the perimeter of said lower flange, when said floatation unit is in a substantially tilted attitude while an attached anchor descends toward the bottom of said body of water, said slots and said spokes also being shaped and adapted to come into effect to trap said anchor line, thus preventing the release of additional said anchor line when said flotation unit returns to a substantially upright attitude after said anchor reaches the bottom of said body of water;

a counterweight of ballast axially centered and fixedly attached within said lower member, said ballast being of sufficient weight to cause said floatation unit to right itself after the tension in said anchor line is substantially reduced when said anchor reaches the bottom of said water body;

a length of said anchor line having one end thereof attached to said floatation unit, and being normally wound around said line storage spool; and said anchor attached to the other end of said anchor line, said anchor having sufficient weight to cause said floatation unit to tilt substantially allowing said anchor line to overcome the effect of said line-trapping element and thus to release said anchor line from said line storage spool by pulling said anchor line off of the edge of said lower flange and out of said line-trapping element while said anchor drops downwardly from the water surface, said anchor further being of sufficient weight to maintain said floatation unit at its position on said water surface after said anchor has reached the bottom of said water body.

2. The marker buoy of claim 1 wherein said upper member further comprises a removable flag and a flagstaff attachment means at the top of said upper member adapted to receive and secure the lower end of a flagstaff of said removable flag.

3. The marker buoy of claim 1, further comprising a line keeper clip fixedly attached to the underside of said floatation unit for optional use to secure said anchor line.

4. The marker buoy of claim 1 wherein said upper member further comprises a removable flag and a flagstaff attachment means at the top of said upper member adapted to receive and secure the lower end of a flagstaff of said removable flag, said marker buoy further comprising a line keeper clip fixedly attached to the underside of said floatation unit for optional use to secure said anchor line.

5. The marker buoy of claim 1 wherein said upper member is substantially hollow and further wherein said upper member and said lower member can be separated members when not in use, but are securely connected together by a connecting means to form said floatation unit in a watertight configuration for use.

6. The marker buoy of claim 5 wherein said upper member further comprises a removable flag and a flagstaff attachment means at the top of said upper member adapted to receive and secure the lower end of a flagstaff of said removable flag.

7. The marker buoy of claim 5 wherein said upper member is composed substantially of translucent material to allow the passage of light and wherein said floatation unit further comprises a removable lighting device and a lighting device attachment means for securing said removable lighting device within said floatation unit.

8. The marker buoy of claim 5 wherein said marker buoy further comprises a line keeper clip fixedly attached to the underside of said floatation unit for optional use to secure said anchor line.

9. The marker buoy of claim 5 wherein said upper member further comprises said removable flag and said flagstaff attachment means at the top of said upper member adapted to receive and secure the lower end of said flagstaff of said removable flag, further wherein said upper member is composed substantially of translucent material to allow the passage of light, and wherein said floatation unit further comprises said removable lighting device and said lighting device attachment means for securing said removable lighting device within said floatation unit.

10. The marker buoy of claim 5 wherein said upper member further comprises said removable flag and said flagstaff attachment means at the top of said upper member adapted to receive and secure the lower end of said flagstaff of said removable flag, said marker buoy further comprising said line keeper clip fixedly attached to the underside of said floatation unit for optional use to secure said anchor line.

11. The marker buoy of claim 5 wherein said upper member is composed substantially of translucent material to allow the passage of light, and wherein said floatation unit further comprises said removable lighting device and said lighting device attachment means for securing said removable lighting device within said floatation unit, said marker buoy further comprising said line keeper clip fixedly attached to the underside of said floatation unit for optional use to secure said anchor line.

12. The marker buoy of claim 5 wherein said upper member further comprises said removable flag and said flagstaff attachment means at the top of said upper member adapted to receive and secure the lower end of said flagstaff of said removable flag, further wherein said upper member is composed substantially of translucent material to allow the passage of light and wherein said floatation unit further comprises said removable lighting device and said lighting device attachment means for securing said removable lighting device within said floatation unit, said marker buoy further comprising said line keeper clip fixedly attached to the underside of said floatation unit for optional use to secure said anchor line.

13. The marker buoy of claim 5 wherein said upper member is tapered inwardly toward the top to allow multiple said upper members to nest together for convenient storage and reduced storage space while not in use, and further wherein said lower member further comprises a concentric groove, shaped and adapted to receive the upper flange of another said lower member to facilitate stacking multiple said lower members for storage.

14. The marker buoy of claim 13 wherein said upper member further comprises a removable flag and a flagstaff attachment means at the top of said upper member adapted to receive and secure the lower end of the flagstaff of said removable flag.

15. The marker buoy of claim 13 wherein said upper member is composed substantially of translucent material to allow the passage of light and wherein said floatation unit further comprises a removable lighting device and a lighting device attachment means for securing said removable lighting device within said floatation unit.

16. The marker buoy of claim 13, further comprising a line keeper clip fixedly attached to the underside of said floatation unit for optional use to secure said anchor line.

17. The marker buoy of claim 13 wherein said upper member further comprises said removable flag and said flagstaff attachment means at the top of said upper member adapted to receive and secure the lower end of said flagstaff of said removable flag, further wherein said upper member is composed substantially of translucent material to allow the passage of light, and wherein said floatation unit further comprises said removable lighting device and said lighting device attachment means for securing said removable lighting device within said floatation unit.

18. The marker buoy of claim 13 wherein said upper member further comprises said removable flag and said flagstaff attachment means at the top of said upper member adapted to receive and secure the lower end of said flagstaff of said removable flag, said marker buoy further comprising said line keeper clip fixedly attached to the underside of said floatation unit for optional use to secure said anchor line.

19. The marker buoy of claim 13 wherein said upper member is composed substantially of translucent material to allow the passage of light, and wherein said floatation unit further comprises said removable lighting device and said lighting device attachment means for securing said removable lighting device within said floatation unit, said marker buoy further comprising said line keeper clip fixedly attached to the underside of said floatation unit for optional use to secure said anchor line.

20. The marker buoy of claim 13 wherein said upper member further comprises said removable flag and said flagstaff attachment means at the top of said upper member adapted to receive and secure the lower end of said flagstaff of said removable flag, further wherein said upper member is composed substantially of translucent material to allow the passage of light and wherein said floatation unit further comprises said removable lighting device and said lighting device attachment means for securing said removable lighting device within said floatation unit, said marker buoy further comprising said line keeper clip fixedly attached to the underside of said floatation unit for optional use to secure said anchor line.

* * * * *